US005816184A

United States Patent [19]

McCulloh

[11] Patent Number: 5,816,184

[45] Date of Patent: Oct. 6, 1998

[54] RIDER SUPPORT ASSEMBLY FOR PARASAILING

[75] Inventor: Mark McCulloh, Orlando, Fla.

[73] Assignee: Controlled Parasailing Corporation of America, Ltd., Georgetown, Cayman Islands

[21] Appl. No.: 770,740

[22] Filed: Dec. 19, 1996

Related U.S. Application Data

[60] Provisional application No. 60/008,934 Dec. 20, 1995.

[51] Int. Cl. [6] ..... B63B 21/04

[52] U.S. Cl. ..... 114/253; 114/254; 244/155 R; 244/1 TD; 244/63

[58] Field of Search ..... 114/242, 253, 114/254; 244/151 R, 151 A, 152, 147, 142, 155 R, 155 A, 901, 63, 1 TD

[56] References Cited

U.S. PATENT DOCUMENTS

| | | | |
|---|---|---|---|
| 2,825,515 | 3/1958 | Gold | 244/151 R |
| 2,919,085 | 12/1959 | Horning | 244/152 |
| 3,987,746 | 10/1976 | McCulloh | 114/254 |
| 4,738,414 | 4/1988 | McCulloh | 114/253 |
| 5,367,972 | 11/1994 | McCulloh | 114/253 |

*Primary Examiner*—Stephen Avila
*Attorney, Agent, or Firm*—Malloy & Malloy, P.A.

[57] ABSTRACT

A parasailing assembly designed to suspend a rider from a parachute being towed by a boat, the assembly including a rider support structure formed of a rigid yet lightweight and buoyant material and having a front end, a rear end, a pair of oppositely disposed sides, a top side, a bottom side, and a hollow interior, accessible from one of the sides. A reclining seat structure is disposed within the hollow interior and is structured to support at least one rider in a generally reclined position. A pair of straps are further provided and formed of a flexible yet high strength material, with each one of the straps securely yet removably connected to one of the opposite sides of the rider support structure such that when the assembly is disposed in a launched orientation each of the straps is disposed in spaced parallel relation to the other and provides for balance and stable movement of the rider support structure. The movement of the straps is guided and restricted to maximize observation of the rider seated within the rider support structure, and each of the pair of straps is connected near a center region thereof with at least one set of riser lines of a parachute so that upon connection of the parachute riser lines the rider support structure is movable between the launched orientation suspended by the parachute filled with air, and a floating orientation on a surface of water when the parachute is not filled with air.

23 Claims, 6 Drawing Sheets

RIDER SUPPORT ASSEMBLY FOR PARASAILING

BACKGROUND OF THE INVENTION

CLAIM OF PRIORITY

The present application is based on and a claim to priority under 35 U.S.C. Section 119(e) is made to a provisional patent application filed with the U.S. Patent Office on Dec. 20, 1995 and assigned Ser. No. 60/008,934.

FIELD OF THE INVENTION

The present invention relates to an improved rider support assembly for use during parasailing which is movable between a launched orientation wherein the rider support assembly is suspended by an air filled parachute and either a floating orientation on a surface of water or a retrieved, landed orientation when the parachute is not filled with air. The rider support assembly of this invention is specifically adapted to offer a more stable ride with increased visibility to an occupant of the assembly in the launched orientation while simultaneously being highly unlikely to capsize in the floating orientation.

DESCRIPTION OF THE RELATED ART

The sport of parasailing is relatively new but has greatly increased in popularity over the last several years. As a result, persons who partake in the sport of parasailing have had relatively few equipment innovations which render the sport both safer and more enjoyable. For example, in the past, parasailing enthusiasts have frequently used equipment designed for other sports such as water skiing, sky diving, hang gliding, etc. as such sports essentially involve the launching and retrieving of a person. It is true that the activity of parasailing, like these related sports, carries a certain amount of risk for injury. However, the lack of proper parasailing equipment and trained personnel, yet alone equipment designed for the comfort of the parasailer, is thought to have aggravated this risk and may have even greatly contributed to a number of serious parasailing injuries.

Due to the increasing popularity of parasailing, a few types of rider supports have been developed and used for parasailing. A very common type of rider support, which is also perhaps the most dangerous, is a harness structure that is attached to the body of the parasailer and supported directly from the riser lines of the parachute. In the harness structure, the parasailer is maintained in an upright, substantially standing position both prior to launching and during parasailing. While this and other types of structures are generally capable of providing adequate support during parasailing, it is believed that they are still lacking of significant safety features. For example, an intolerable risk exists when a parasailer lands in the water, namely, that he will become entangled in the parachute and/or in the parachute's riser lines. Another common problem confronting known rider support structures is that the body of the parasailer is substantially exposed. This can be dangerous given the sometimes unpredictable effect of windy conditions which may cause a parasailer to inadvertently impact land or to suddenly and severely impact the water.

As demonstrated by my patented inventions in U.S. Pat. No. 3,987,746, U.S. Pat. No. 4,738,414 and U.S. Pat. No. 5,367,972, I have endeavored over the last several years to innovate parasailing equipment so as to reduce the safety hazards associated with parasailing and in general, to make parasailing more safe, more comfortable and less threatening to those who would otherwise venture into it. For example, my U.S. Pat. No. 4,738,414 incorporated herein by reference, is directed towards innovative parasailing equipment associated with efficiently and safely launching and retrieving a parasailer and also, towards a rider support structure which maintains the parasailer in a somewhat seated and reclined position within a buoyant structure should it inadvertently land on the water. Even so, there remains a need in the art for a rider support structure for use by parasailing enthusiasts such as was described in my U.S. Pat. No. 4,738,414 but which is greatly improved. For example, yet another common problem confronting such known rider support structures is presented by the traditional manner in which the parachute riser lines are attached to the parasailer, typically to the harness support structure or other rider support structure. Specifically, there are generally three distinct groupings of parachute riser lines which are disposed on e.g., the right side of the parasailer and another three distinct groupings of parachute riser lines which are disposed on e.g., the left side of the parasailer. Typically, these are attached as follows: the first, forward-most set of the riser lines on each side (the "top" riser lines) are attached to a towing rope for towing by a vehicle; the second, center set of the riser lines on each side (the "apex" riser lines) are often attached to the parasail, reaching the highest point thereon or apex, although on occasion this set of riser lines may be left unattached; the third, rear-most set of the riser lines (the "bottom" riser lines) are attached to the parasailer. However, as this standard arrangement of attaching parachute riser lines yields several pulling points, it can and often does result in unexpected directional changes of the parachute and parasailer during flight. That is, depending on the wind conditions, or on certain movements of the parasailer, including an uneven parasailing weight load, during flight, it is possible for the parachute to ascend, descend, veer to one side or to do any of the above suddenly and unexpectedly. This unpredictable shifting ability in the attitude of the parachute carries the potential for resulting in an unstable and frightening flight.

Thus, there remains an appreciable need in the art for a parasailing rider support assembly which reduces, if not eliminates, unexpected directional changes of the parachute and parasailer during flight. Any such improved parasailing rider support assembly should also, during flight or the launched orientation, be able to resist the force of higher wind gusts, such as over fifteen (15) miles per hour, and resist other destabilizing forces exerted such as occasionally occur during turns or when an uneven payload is being carried on the rider support structure (e.g., when a heavy male and lightweight female parasailers are seated side-by-side therein). There also remains a need for an improved parasailing rider support structure which can essentially encapsulate and thereby protect the parasailer during a swift or sudden landing, should one occur, and further, for a structure which is highly unlikely to capsize should it land on the water, even during windy or agitated water surface conditions. Finally, there is also a need for an improved rider support structure which is more readily and highly visible for parasailing occupants and, which at the same time, offers a more sturdy and therefore, an even safer ride to a customer during the launched orientation of parasailing. The present invention is designed to satisfy the needs in the art and is believed to represent a significant advance in the field of rider support assemblies for parasailing enthusiasts.

SUMMARY OF THE INVENTION

The present invention is directed towards a new and improved rider support assembly for parasailing. The present invention, which is specifically adapted to offer a more stable less frightening ride to parasailers, increased visibility and to be less likely to capsize in a floating orientation, is seen to comprise a rider support structure which is configured to support at least one rider on a reclining seat structure thereof in a generally reclined position, and preferably a plurality of riders thereon, in a substantially seated position. The rider support structure of this invention is formed of a rigid and yet substantially lighter weight material and is structured to extend substantially if not completely about the parasailing occupant(s) so as to offer protection in the event of a sudden or abrupt landing. Further, the rider support of the present invention is formed to be more buoyant than previously known devices so as to readily float should it land on the water and in the preferred embodiment, may have an aerodynamic shape. The assembly of this invention further comprises improved guide means attached to the rider support structure which preferably include a pair of upstanding, rigid, tubular arm members, each tubular arm member being secured to an upper exposed surface of the rider support at one side thereof, and each being oppositely disposed and in spaced parallel relation to each other. The assembly of this invention also includes improved interconnecting means for interconnecting the rider support assembly to the parachute riser lines and thus to the parachute, which preferably comprise a pair of flexible yet high strength straps, each of which is securely yet removably connected to opposite sides of the rider support, each strap being disposed in spaced parallel relation to the other, and each strap ideally being passed through one of the upstanding, rigid, tubular arm members. Further, the present invention includes an improved parachute strap assembly which comprises connecting means that preferably include a pair of interconnecting links. In a more preferred embodiment, each interconnecting link is securely formed on a central region of each flexible yet high strength straps and is securely sewn onto a common base portion of a set of three groups of riser lines.

Thus, in assembled form and during a launched orientation when the parachute is filled with air, the rider support may be disposed in depending relation to the parachute. In use, the improved rider support structure of this invention preferably cooperates with tow line structure connected thereto, a launching assembly and a motorized boat so that the rider support structure may therefore be movable between a launched orientation suspended by the parachute when the parachute is filled with air and when the parachute is not filled with air, either a retrieved, landed orientation such as when the rider support is returned to a launching platform, or a floating orientation should the rider support land on the surface of the water.

It is a primary object of the present invention to provide an improved rider support assembly for parasailing which is inherently more safe than other rider supports by reducing unexpected directional changes of the parachute and parasailing assembly during flight and providing a smoother, more sturdy ride during the launched orientation of parasailing.

Another primary object of the present invention is to provide an improved rider support assembly for parasailing which more evenly distributes the weight of an occupied rider support structure during the launched orientation of parasailing, thereby resulting in a sturdy structure which is resistant to wind gusts as well as other destabilizing forces such as might occur during turns and/or if an uneven payload is seated within the rider support structure.

Another primary object of the present invention is to provide an improved rider support assembly for parasailing which permits the operators of a parasail outing to readily and easily observe the rider support and its occupants and which permits the occupants more visibility.

Yet another object of the present invention is to provide an improved rider support assembly for parasailing which is floatable and unlikely to capsize in the event that the rider support assembly lands on the water instead of being returned to a launching platform, even during windy or agitated water conditions.

A feature of the improved rider support structure according to this invention is that it includes an aerodynamic shape.

It is also an object of the present invention to provide a rider support assembly for parasailing having improved and secure interconnecting means that can nonetheless be quickly and easily disconnected from the rider support structure so as to permit the parachute and its riser lines to be interconnected with a traditional harness type of rider support structure, whenever desired by a parasailing enthusiast.

It is also an object of the present invention to provide an improved rider support assembly for parasailing which maintains the rider in a generally reclined position and which is highly comfortable to the parasailing occupants of the rider support.

BRIEF DESCRIPTION OF THE DRAWINGS

For a fuller understanding of the nature of the present invention, reference should be had to the following detailed description taken in connection with the accompanying drawings in which:

FIG. 10-A is an isolated close up view of the improved interconnecting means about to be connected with and a standard arrangement of three groups of riser lines.

Like reference numerals refer to like parts throughout the several views of the drawings.

DETAILED DESCRIPTION OF THE PREFERRED EMBODIMENT

Figure 2:
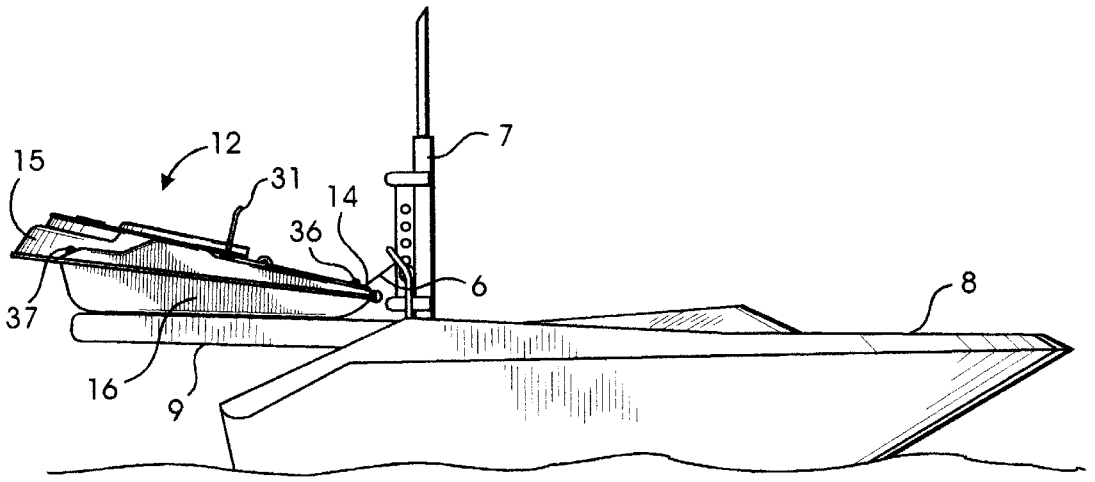
FIG. 2 is also a perspective view of the improved rider support structure illustrated in a retrieved position on a launching platform of a tow craft in the form of a motorized boat.
Figure 5:
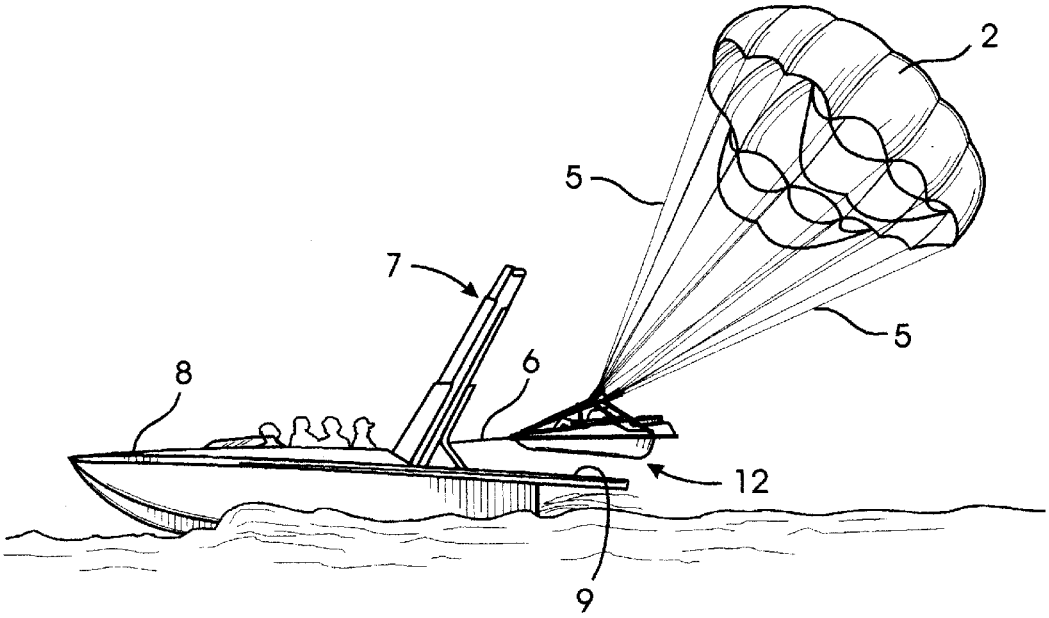
FIG. 5 is a perspective side view of the parasailing assembly of this invention illustrating the rider support structure being moved into a launched orientation.
Figure 6:
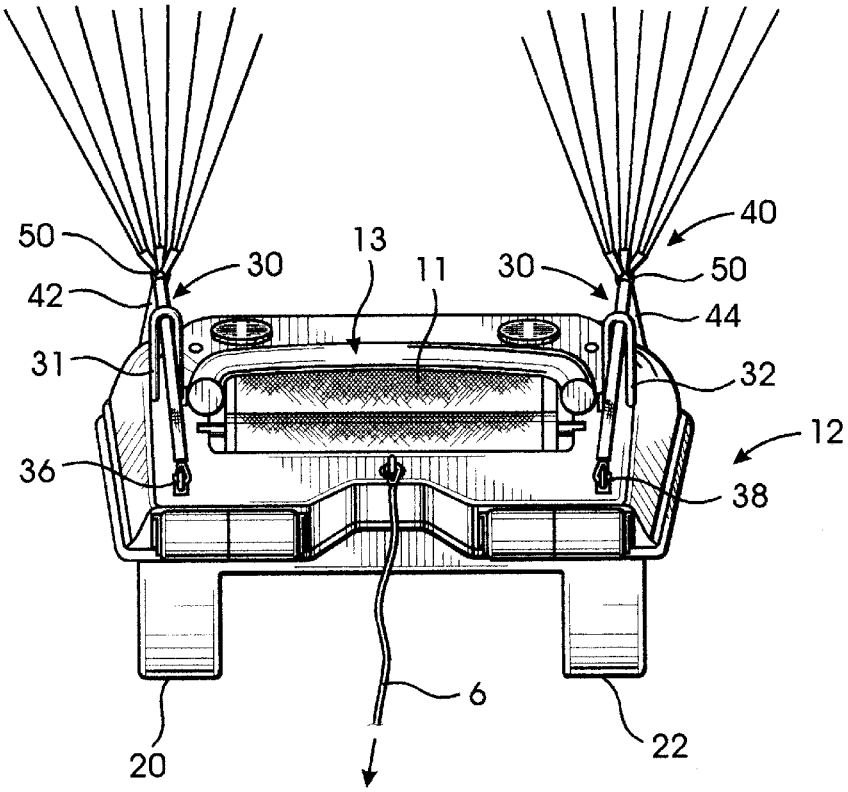
FIG. 6 is a front view of the parasailing assembly illustrated in FIG. 5.

Illustrated throughout the drawings, the present invention is directed towards an improved rider support assembly for parasailing and is generally indicated as 10. The present invention, is designed to be interconnected and used with a parachute 2 and riser lines 5 such as best illustrated in FIGS. 5 and 6. In typical fashion associated with the sport of parasailing, an ascending parachute is inflated or suspended by the wind or alternately by the rapid forward motion of a tow craft 8, causing the occupant and in the case of this invention, the rider support assembly 10 to be lifted, as in FIG. 5. The term "inflated" as used herein relative to the inflation or suspension of the sheet portion of the parachute 2 does not in fact mean that the parachute contains inflatable portions but rather that the sheet is expanded and suspended by on-rushing wind. From the drawings, it will be appreciated that in assembled form and during a launched orientation when the parachute is filled with air, the rider support assembly 10 is disposed in depending relation to the parachute 2. It will also be appreciated that in use, the improved rider support assembly 10 preferably cooperates with a tow vehicle such as a motorized boat 8, with tow line structure 6 connected thereto, and a launching assembly 7 including a launching platform 9 on the motorized boat 8 so that as the tow line is payed out when the boat is moving forward, the rider support assembly 10 may be moved into a launched orientation depicted in FIGS. 5 and 6 wherein the rider support assembly 10 is suspended by the parachute 2 as the parachute is filled with air. The rider support assembly 10 is also movable into another position, when the parachute is not filled with air, namely, into either a retrieved, landed orientation such as when the rider support is returned to launching platform 9, illustrated in FIG. 2, or a floating orientation should the rider support assembly 10 land on the surface of the water.

Figure 1:
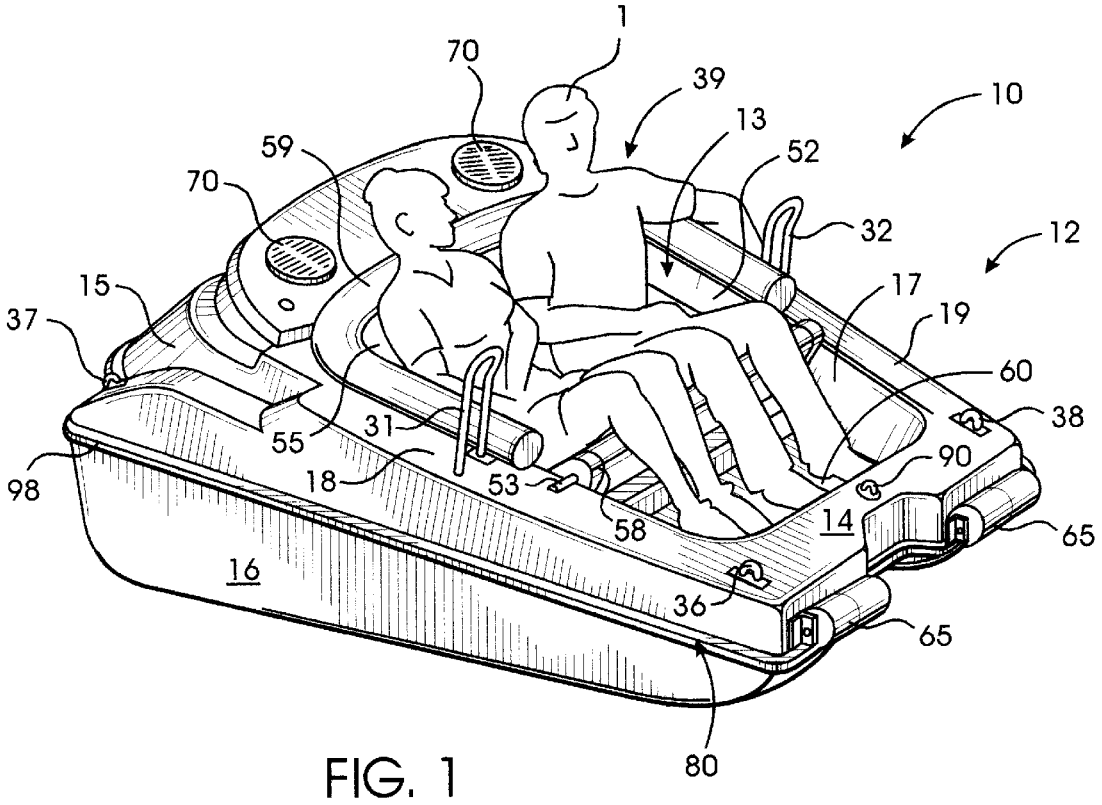
FIG. 1 is a perspective view of the preferred embodiment of the improved rider support structure of the present invention and illustrating two occupants seated therein.
Figure 11:
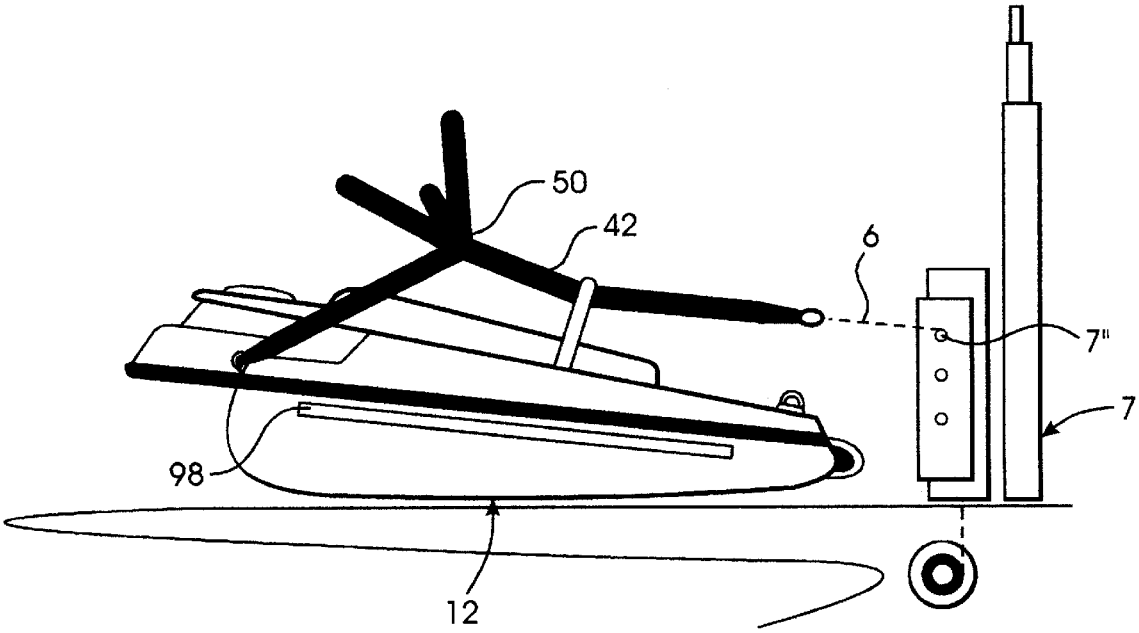
FIG. 11 is a side view illustrating the improved interconnecting means having a two point connection and connected with a standard, high tow point tow line structure.

Referring now to FIG. 1, the improved rider support assembly 10 includes a rider support structure, generally indicated as 12, and is designed to comfortably and safely maintain at least one rider or occupant 1, therein during the activity of parasailing. In a preferred embodiment, the rider support structure accommodates a plurality of parasailers such as two or three and possibly more, and further, includes a reclining seat structure 13 to maintain the occupants in at least a partially reclined position and preferably, in a substantially reclined position so as to render seat belts or other restraints unnecessary. With regard to this seat structure 13, it preferably comprises a seat brace 53 that extends transversely across the width of the rider support 12 and is securely connected to the rider support structure 12. In addition to brace 53, a seat back support portion 55 which may also extend transversely or arcuately across the width of the rider support, is securely fastened for example, by way of conventional fasteners, to rider support structure 12. While a sling or cradle type structure, which may be made of a flexible yet high strength canvas or like material 52 can be strung between the seat brace 53 and the seat back support portion 55, the improved rider support structure 12 of this invention preferably includes a more sturdy and padded reclining and seating support member 11 extending between brace 53 and portion 55, which is also formed to extend deeply into the interior of the rider support 12 so as to effectively cradle the lower or seat portion of the occupant. The deep seating of the seat structure 13 makes it extremely difficult or impossible for the rider to become inadvertently dislodged from the rider support structure 12 or to fall therefrom. Cushion members 58 and 59 may be disposed in surrounding relation to the seat braces 53 and the seat back support portion 55. For example, one cushion member 58 may be disposed in underlying and cushioning relation to the leg or knee portion of the occupant and the other 59 may be disposed in underlying, cushioning and supporting relation to the back portion of the occupant. In addition, rider support 12 may include additional structure such as a slotted foot rest 60 which acts to soften the landing of the rider support 12 on the water and to allow water to penetrate therethrough. Thus, slotted foot rest 60 is a significant feature in that it assists with the stability of the rider support in the floating orientation and further, provides not only a foot rest but a stop element which will prevent an anxious occupant from accidentally passing therethrough and into the water. Further, rider support 12 may also include a battery operated stereo system 70 operably connected within rider support 12 and if desired, a lighting system 80, which may even be decorative, e.g., provided with neon lighting 98, as illustrated in FIG. 11, so as to illuminate the rider support during dusk or nighttime parasailing.

The rider support structure 12 of the present invention is designed to substantially, if not completely encircle the parasailing occupant(s). From the drawings, it will be appreciated that the rider support 12 acts almost as a bumper car in that it is formed of a rigid material on all sides, including the front 14, rear 15, and opposite sides 16, 17, of the rider support. Thus, rider support 12 offers the occupant a rigid and high strength structure which extends three hundred and sixty (360°) degrees about him, including underneath him, which offers the occupant more protection in the event of an abrupt landing. Given that the rider support structure 12 must also become airborne, it preferable to form the rider support structure 12 of a rigid and yet substantially lightweight material so as not to decrease efficiency and reduce drag while maintaining the benefits of being rigid and high strength. To accomplish this, it has been determined that most preferably, the rider support structure 12 will be formed of a suitable, rigid and yet floatable structure made out of a high strength fiberglass resin known as vinyl ester in conjunction with a high strength fiberglass material sold under the well known trademarks Ny-tex or Kevlar, which offer vastly increased strength of normal fiberglass while being approximately half the weight. Further, the rider support 12 of the present invention is formed to be buoyant so as to float should it land on the water and in the preferred embodiment, is formed by joining together two halves, namely a top half and a bottom half of the fiberglass constructed material. The two halves are preferably fastened together by conventionally known fasteners and are provided with a watertight seal about their seams which may be formed by many types of marine caulking and thus, as assembled, rider structure 12 offers a highly buoyant structure. The combination of the preferred material and the design of the rider structure 12 offers the advantage of not only being buoyant but also, the advantages of being easy to clean, unlikely to deteriorate and further, rust and corrosion resistant. The latter is important given that the rider support 12 is in frequent contact with water and/or will generally be located in very close proximity to water, if not also to hostile environments such as high salt concentrations of water, known to be highly corrosive.

Figure 8:
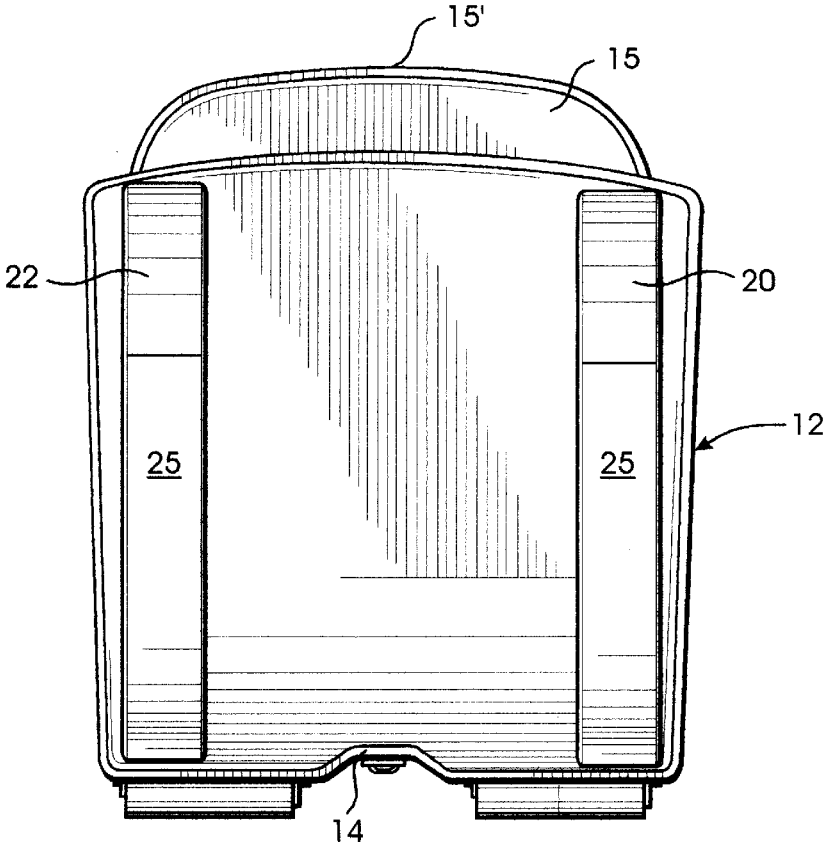
FIG. 8 is a bottom plan view of the rider support structure according to this invention.

As best shown in FIGS. 6 and 8, the rider support 12 includes a pair of spaced apart float structures 20, 22 formed to an undersurface of the structure 12. Spaced float structures 20, 22 which may be in the form of pontoons, are preferably integrally formed with the rider support 12 so as to eliminate the potential that they will be separated from structure 12 in the event of a high speed water landing. Moreover, spaced float structures 20, 22 preferably extend substantially along the length of the rider support undersurface and preferably, each has a flat exposed surface 25 which is of a width of generally about six inches. While float structures 20, 22 are spaced apart and may be disposed in a parallel orientation relative to each other, most preferably, float structures 20, 22 are disposed on rider support 12 so as to have a corresponding pair of ends closer together than the other pair of ends. Ideally, the pair of float structure ends nearest the front 14 of rider support 12 will be closer together than the pair of float structure ends nearest the rear 15 of the rider support 12. Thus, float structures 20, 22 may appear to form a slightly "V" or wedge shape as viewed from a bottom of the assembly, see FIG. 8, and it will be appreciated that this shape provides increased stability and balance during flight and also should the structure land on water to assume a floating orientation. Specifically, when the rider support assumes a floating orientation, the area of increased separation between float structures 20, 22 corresponds the location of the occupants and thus, the area of the support bearing more weight. Moreover, because of the configuration of the float structures 20, 22 relative to one another, a softer, more stable landing is achieved into the water, with a resultant splash minimized thereby. Indeed, such a configuration provides a more comfortable ride in the air and a more comfortable and splash resistant landing in the water. Further, as entire bottom surface of the rider support 12 is preferably buoyant, it rests on the water to maintain stability during floating, especially if there is uneven weight distribution within the rider support 12. Moreover, the rear 15 of the rider support 12 preferably includes a protruding, buoyant rear extension section 15' structured to float directly on the surface of water and substantially increase a floating stability of the rider support 12. For example, as the rider support 12 rests on the water a surface the weight of the passengers is directed towards the rear and should the parachute fill with air it may tend to pull back on and tip the rider support 12. In this embodiment, the buoyant rear extension segment 15' maintains substantial stability. Finally, in the preferred embodiment, rider support 12 has a sleek, aerodynamic appearance that is generally wedge shaped as best illustrated in the drawings.

Figure 3:
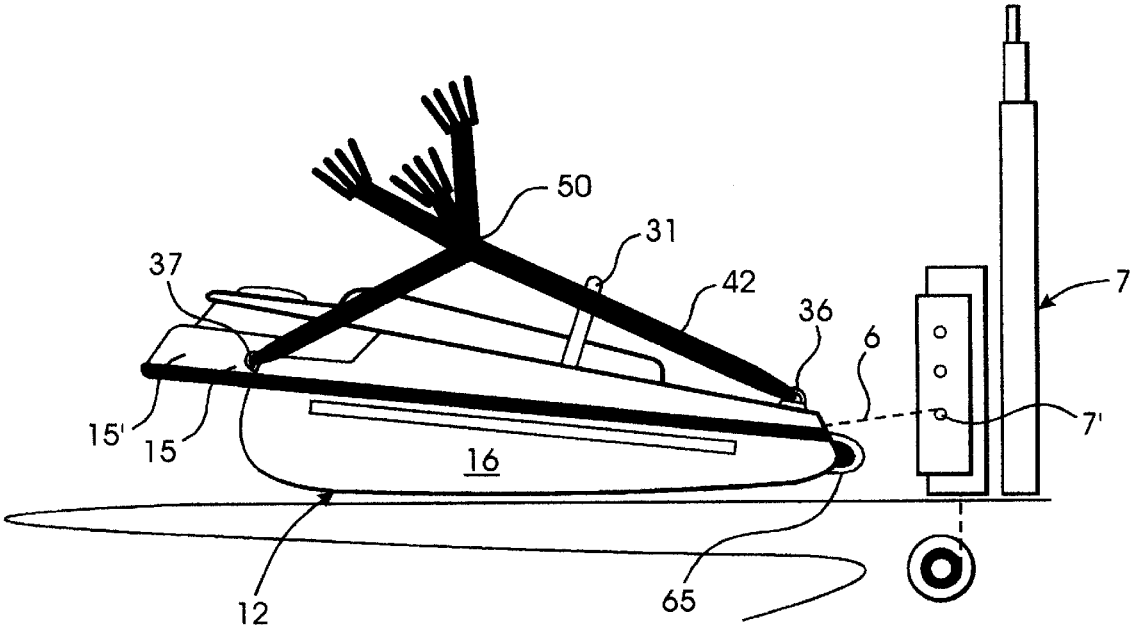
FIG. 3 is a side view illustrating the improved guide means and improved interconnecting means according to the present invention, in an operative position with the improved strap assembly of the present invention.

The rider support assembly 10 of this invention preferably includes guide means 30 which interact with the improved interconnecting means 40, described below, and help to provide for a more stable and yet highly visible assembly while parasailing is underway. The guide means 30 preferably comprise a pair of upstanding, rigid, tubular arm members, 31, 32. As best illustrated in FIGS. 1 and 3, each tubular arm member 31, 32 is coupled to, and is preferably securely mounted to an upper exposed surface 18, 19 of the rider support 12 at opposite sides 16, 17 thereof, and in substantially parallel relation to each other. In a preferred embodiment, arm members 31, 32 have an appearance of an inverted "U" shape, are made of a high strength metallic material, such as stainless steel, and are disposed at or near a center region on each of upper sides 18, 19 of structure 12 or nearer the front end thereof than the rear end thereof. Most preferably, arm members 31, 32 are generally about twelve to fourteen inches in height, and up to generally about twenty-four inches in height in an alternative embodiment, and have an overall width of about four inches, and in this way do not interfere with the visibility of either the parasailing occupants or the operation. If desired, cushioning members may be disposed in surrounding relation to arm members 31 and 32 for the comfort of the occupants.

Figure 7:
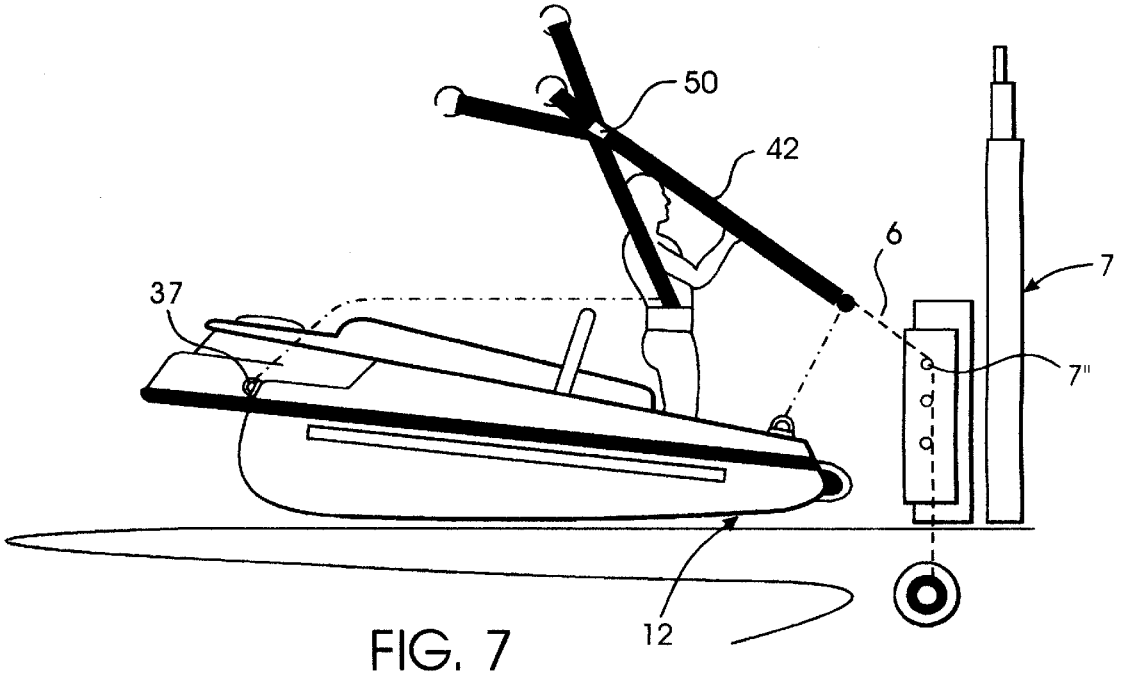
FIG. 7 is a side view illustrating removal of the connecting means from the rider support structure and the interconnection of the interconnecting means with the parachute and its riser lines to adapt for use with a traditional harness type of rider support structure.

Referring now to FIGS. 3 and 6, the improved rider support assembly 10 of this invention further comprises improved interconnecting means 40 for interconnecting the rider support 12 to the parachute riser lines 5 and thus to the parachute 2. The interconnecting means 40 include a pair of flexible yet high strength straps 42, 44. In the preferred embodiment, straps 42, 44 are made of a high strength nylon webbing material which offers the advantages of also being durable and shock absorbent. Using such nylon straps as connecting means offers several distinct advantages: first, they are inexpensive; second, they have a longer life than that of the parachute 2 and can be disposed of with the parachute; and third, are not a maintenance problem as they are easily replaced and/or are interchangeable. On the contrary, the rigid, metal brace structures of my prior invention were permanent in nature and tended to corrode in the water environment or on occasion, to develop a stress fracture which is not easily detected. Moreover, as each strap 42, 44 has a preferred width dimension of generally about two inches, this adds to the very visible nature of the overall assembly 10. Also in the preferred embodiment, each of straps 42, 44 is securely yet removably connected to opposite sides 16, 17 of the rider support 12, and more preferably, each end of one strap attaches to one of two corners of one side, such as at 36, 37 and 38, 39 of the rider support. As has been described, straps 42, 44 are removably attached to the rider support 12, and this is preferably accomplished by the secure attachment of conventional metal snapping hooks e.g., stainless steel shackle clips, to each end of straps 42, 44 which then mate in assembled form with conventionally known metal eye structure secured to each corner 36–39 of the rider support 12 as best illustrated in FIG. 1. It will thus be appreciated that each strap 42, 44 can easily and quickly be removed from the rider support, for example within a few minutes, so as to permit attachment to a traditional harness type of rider support structure as illustrated in FIG. 7, whenever that may be desired by a parasailing enthusiast. Because a primary purpose of the present rider support assembly is to offer parasailers greatly increased safety features over the traditional harness type of support structure though, including the offer of a lower tow point described below, it is more preferable that straps 42, 44 be utilized in conjunction with the rider support 12, and straps 42, 44 are disposed to be in spaced parallel relation to each other, which becomes evident, when the assembly assumes a launched orientation such as shown in FIGS. 5 and 6. Further, it will be noticed that each strap 42, 44 cooperates with one of upstanding arm members 31, 32 as each strap is preferably passed through one of arm members 31, 32 when the rider support assembly 10 is put in assembled form. It will thus be appreciated that during flight, arm members 31, 32 act as means for guiding straps 42, 44 respectively, so as to maintain each strap in a linear arrangement, and prevent twisting thereof.

Figure 4:
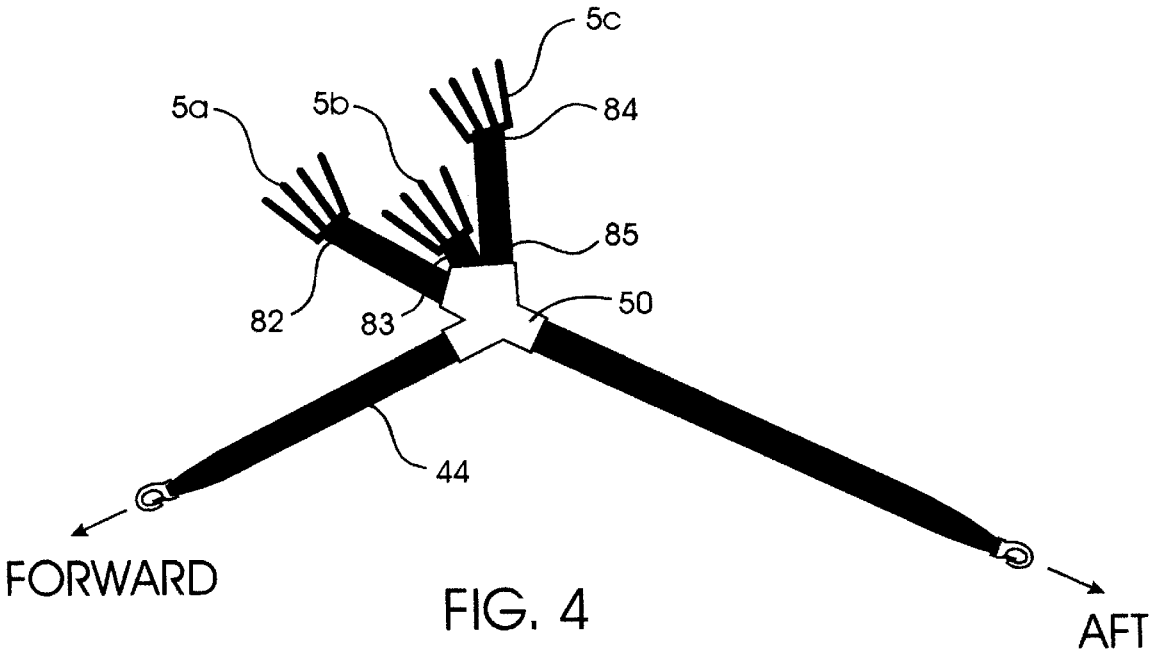
FIG. 4 is an isolated close up view of the improved interconnecting means and strap assembly of the present invention and a set of three groups of three riser lines which extend to the peripheral regions of the parachute.
Figure 9:
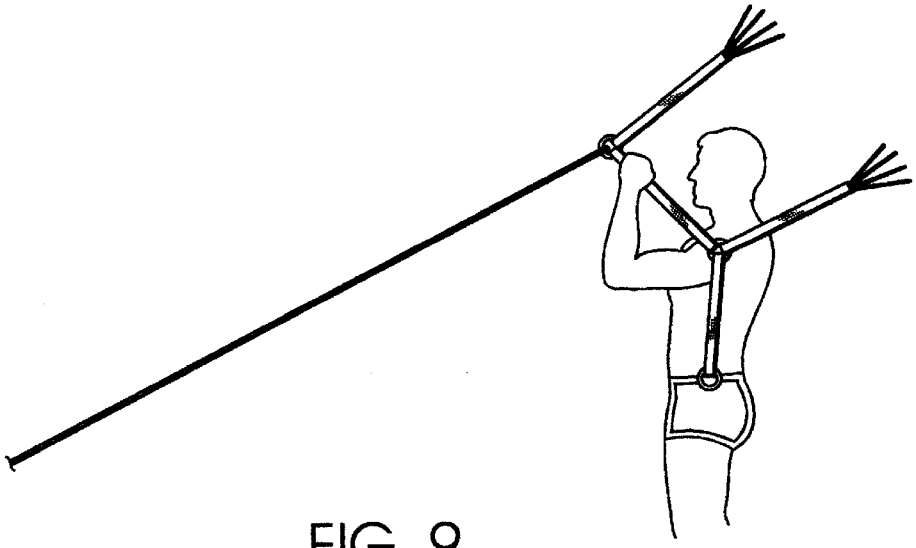
FIG. 9 is a perspective view of a rider in a traditional harness type of rider support structure and showing a standard parasail strap assembly with the standard higher tow point.

Referring now to FIG. 4, the present invention also comprises improved connecting means which preferably include a pair of interconnecting links 50 for connecting the flexible straps of the rider support structure 12 to the parachute riser lines 5 and thus to the parachute 2. Interconnecting link 50 is structured and disposed to securely join together one strap 42 or 44 with one set of the generally three distinct groupings of parachute riser lines; see FIG. 4. As has been explained, there are generally three distinct groupings of parachute riser lines which are disposed on e.g., the right side of the parasailer and another three distinct groupings of parachute riser lines 5*a–c* disposed on e.g., the left side of the parasailer, the latter of which is illustrated in FIG. 4. Typically, these are: the first, forward-most set of the riser lines ("top") 82; the second, center set of the riser lines ("apex") 83; and the third, rear-most set of the riser lines ("bottom") 84; this is a typical arrangement for parasailing riser lines for the parachute. However, as part of the improved connecting means of this invention, each set of the three groupings of riser lines have been joined together at a lower region or common base portion thereof 85 so as to no longer have any intervening structure such as pins or bolts passing therethrough to separate these riser lines. Further, as part of the improved connecting means of this invention, these three riser lines are attached directly at a single point to only one structure, preferably an interconnecting link, and no longer to more than one structure as was the case in the past when a first group of riser lines connected to the tow line, thereby acting as a higher tow point, seen in FIG. 9, compared to the present as invention. Thus, it can also be regarded as my invention, and as seen in FIGS. 3 and 4, that each grouping of three riser lines is securely sewn together forming a common base portion, which can then, be securely joined together with one of straps 42, 44 by interconnecting link 50, thereby creating one fulcrum point instead of more than one. Preferably, interconnecting link 50 is also formed of a high strength webbing material and one interconnecting link 50 is each securely sewn together with or onto each of the flexible straps 42, 44 and lower region 85 on each set of riser line groupings. Also in the preferred embodiment, interconnecting links 50 are disposed generally near or ideally, at a center region of each strap, 42, 44. Thus, during flight, the weight of the rider structure 12 pulls downwardly under the force of gravity and tension, from interconnecting link 50 and becomes the central point or apex of each strap, best seen in FIG. 3. It will be appreciated that this feature can act to more evenly distribute the weight of the parasailing assembly. For instance, should there be a sudden gust of wind during flight of the assembly or should the occupants of structure 12 shift their weight therein, the effect on the rider support will not be as sudden but instead will be delayed and/or reduced. More significantly, because each set of three groupings of riser lines is now interconnected at the same central point and not to two or more different structures like the arrangement of parachute riser lines relied in the past, the problem of unexpected directional changes of the parachute and parasailer during flight is greatly reduced, if not eliminated. That is, the parachute is no longer as likely to ascend, descend, veer to one side or to do any of the above suddenly or unexpectedly in response to gusts of wind or certain movements of the parasailer, including an uneven parasailing weight load. Thus, it has been determined that the improved connecting means of this invention offer greater stability of the assembly during flight.

Moreover, a significant improvement offered by the flexible nature of the connecting means 40 and the relatively small size of the guide means 31, 32 is that should the assembly 10 land on the water, it is less likely to capsize. Specifically, once the rider support 12 is no longer suspended, it may take some time for the parachute 2 to become deflated. Under windy conditions, the wind can act on the parachute and cause it to pull on the connecting means. In my previous patent, the parasailing assembly was taught to include a rigid, metal brace structure that extended substantially upwardly from the rider support and to which attached the means for connecting the parachute. It will be appreciated that this rigid, upwardly extending brace structure maintained the various connection points of the parachute riser lines relatively high in the air, above the rider structure, with the result that the tugging action of the wind and the parachute could cause the floating rider support structure to topple over or capsize, which on occasion has occurred with the assembly taught in my previous patent. With the present invention, the flexible nature of the connecting means 40, 50 tend to collapse and not remain rigid and upright because they are not attached to any rigid brace structure, indeed not even to guide means 30, 31, 32. This greatly reduces if not avoids altogether the possibility that the rider support 12 of the present invention will capsize in the water.

As has been described, during its use, the improved rider support assembly of this invention preferably cooperates with a tow vehicle such as a motorized tow boat 8 and tow line structure 6 which can be conveniently connected to the rider support 12 as illustrated in FIGS. 1 and 5 by conventionally known fastening means 90. It should be appreciated from the drawings that the placement of the tow point 90 at the center of the rider support structure 12 results in the assembly's having a lower tow point than was known previously which further acts to offer a more balanced and stable ride to the parachute rider. Also, as has been described, during its use, the improved rider support structure 12 of this invention can be launched by way of a launching assembly 7 and may therefore be movable between a launched orientation suspended by the parachute and either a retrieved, landed orientation such as when the rider support is returned to a launching platform 9, or a floating orientation should the rider support 12 land on the surface of the water. To avoid denting of the rider support 12 and/or of the tow boat 8 in the preferred embodiment the rider support 12 will include bumper structure 65 attached to front side 14 of the support 12 as shown in FIG. 1.

Figure 10:
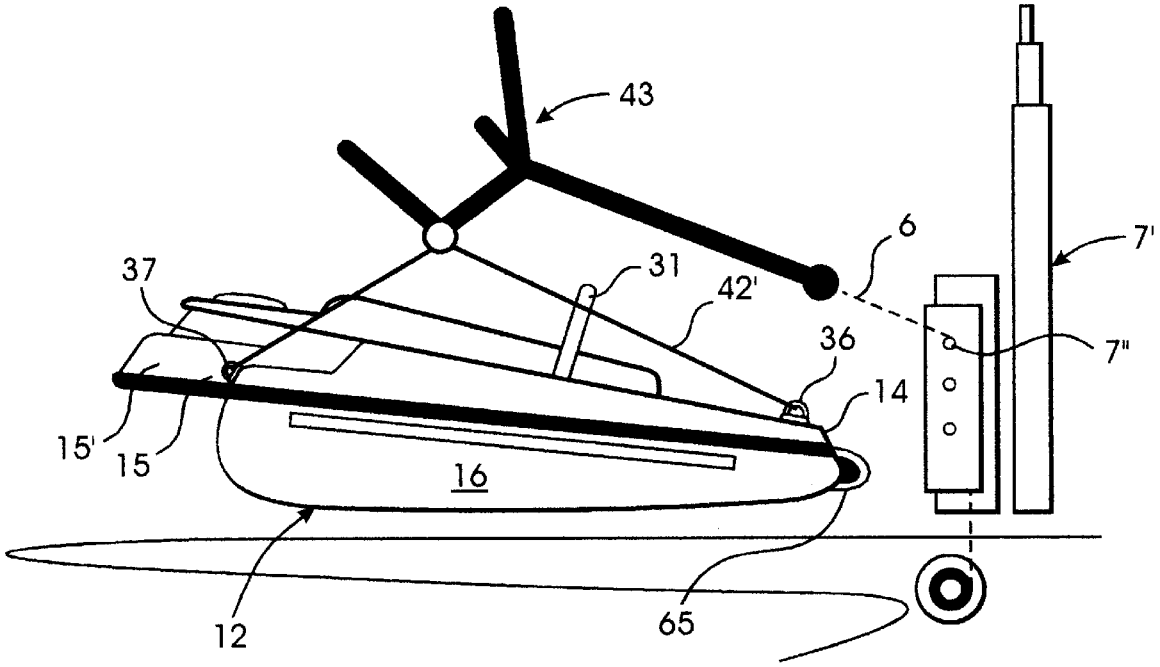
FIG. 10 is a side view illustrating the improved guide means and improved interconnecting means according to the present invention in an operative position with a standard arrangement of parasail riser lines.
Figure 10A:
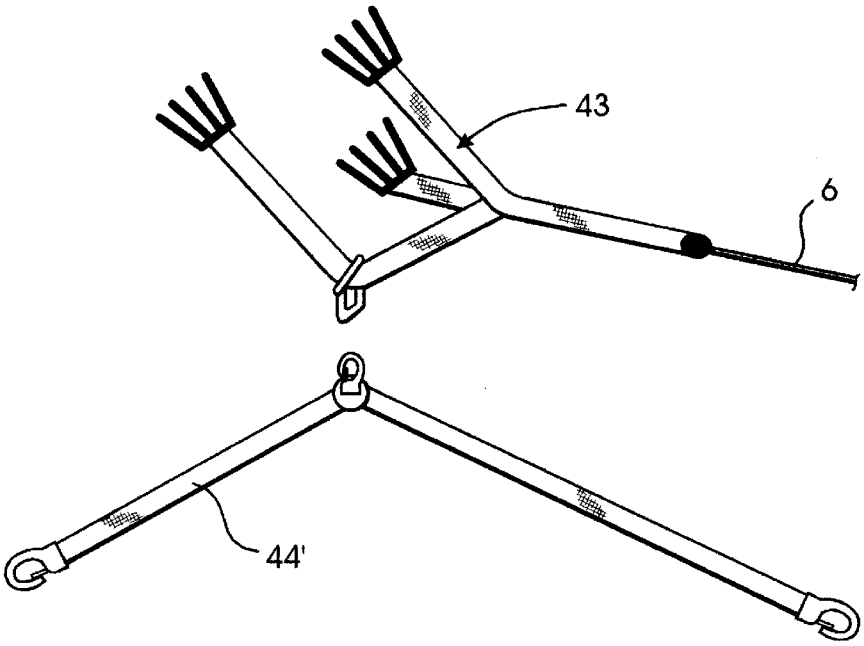

Looking to FIG. 3, and as previously recited, the preferred configuration of the interconnecting means include straps 42,44 secured to the rider support 12 and the tow line structure 6 secured to the rider support 12 at a lower tow point connection 7" of the launching assembly 7. Because, however, in some instances a user may prefer to utilize the rider support 12 with a standard harness configuration 43, and/or with a standard, high tow point connection 7", the alternative embodiments of FIGS. 10, 10-A and 11 are provided. Specifically, in FIGS. 10 and 10-A, the improved interconnecting means include the standard harness configuration 43 connected to a four point strap assembly 42', 44' which is secured to the rider support 12. Such a configuration permits the tow line structure 6 to be connected to the standard harness 43 and secured to the launching assembly 7 at the high tow point connection 7". Such a connection eliminated the need to significantly modify the existing launching assembly 7. Alternatively, however, the preferred configuration of the straps 42, 44 of the improved interconnecting means can also be connected at the high tow point connection 7", as illustrated in FIG. 11. In this embodiment the four point connection of the interconnecting means permits detachment of the straps 42, 44 from the forward connection points and subsequent connection directly with the tow line structure 6 that extends from the high tow point 7". Indeed, such a configuration maintains the safety associated with the preferred embodiment configuration, while providing a ride akin to that experienced with a standard harness configuration. Furthermore, so as to maintain stability, the forward portion of those straps can be secured with one another, and preferably pass beneath the guide means 31 to preserve balance and stability.

Since many modifications, variations and changes in detail can be made to the described preferred embodiment of the invention, it is intended that all matters in the foregoing description and shown in the accompanying drawings be interpreted as illustrative and not in a limiting sense.

What is claimed is:

1. A rider support assembly for parasailing, said assembly comprising:

a rider support structure formed of a substantially rigid yet substantially lightweight and buoyant material, said rider support structure having a front end, a rear end, a pair of oppositely disposed sides, a top side, a bottom side, and a generally hollow interior accessible from one of said sides;

a generally reclining seat structure disposed within said hollow interior of said rider support structure, said reclining seat structure being structured and disposed to support at least one rider therein in a generally reclined position, flexible yet high strength interconnecting means for securely yet removably interconnecting said rider support structure to riser lines of a parachute, said interconnecting means being connected generally at a front left corner, a front right corner, a rear left corner and a rear right corner of said top side of said rider support structure so as to provide for balance and stable movement of said rider support structure when the assembly is disposed in a launched orientation, said flexible yet high strength interconnecting means being structured and disposed to maximize observation of the rider seated within said rider support structure, and upon interconnection of the parachute riser lines, said flexible yet high strength interconnecting means and said rider support structure, said rider support structure being movable between the launched orientation, wherein said rider support structure is suspended by the parachute when filled with air and disposed in depending relation thereto, and a floating orientation on a surface of water when the parachute is not filled with air.

2. A rider support assembly for parasailing as recited in claim 1, wherein said interconnecting means comprise a pair of straps, each strap having a first end and a second end, with said first end removably connected to one of said front corners of said rider support structure and with said second end removably connected to one of said rear corners of said rider support structure such that when the assembly is disposed in the launched orientation, said straps are disposed in a spaced, generally parallel relation to the each other.

3. A rider support assembly for parasailing as recited in claim 2, wherein each of said straps is formed of a high strength nylon webbing material and includes an aperture formed at a center region thereof for interconnection with the riser lines of a parachute.

4. A rider support assembly for parasailing as recited in claim 1, wherein said interconnecting means comprise at least one strap with a first end and a second end securely yet removably connected together, said strap passing through a rigid, eyelet structure fastened to each of said corners of said rider support structure.

5. A rider support assembly for parasailing as recited in claim 1, wherein said interconnecting means are structured to be removed from said front left corner and said front right corner of said rider support structure so as to be coupled with a standard, high tow point tow line structure.

6. A rider support assembly for parasailing as recited in claim 1, wherein said bottom side of said rider support structure includes a pair of spaced apart float structures defining a generally wedge shaped configuration structured to maintain aerodynamic stability of said rider support structure, while also substantially softening a landing of said rider support structure into the surface of water minimizing a splash caused thereby and maintaining hydrodynamic stability.

7. A rider support assembly for parasailing as recited in claim 6, wherein said bottom side of said rider support structure is structured to float directly on the surface of water, with said float structures disposed beneath the surface of water so as to provide a substantially stable, full floatation to said rider support structure.

8. A rider support assembly for parasailing as recited in claim 1, wherein said bottom side of said rider support structure includes a protruding, buoyant rear extension section structured to float directly on the surface of water and substantially increase a floating stability of said rider support structure.

9. A parasailing assembly designed to suspend a rider from an air filled parachute being towed by a boat, said assembly comprising:

a rider support structure formed of a rigid yet substantially lightweight and buoyant material, said rider support structure having a front end, a rear end, a pair of oppositely disposed sides, a top side, a bottom side, and a generally hollow interior accessible from one of said sides;

a reclining seat structure disposed within said hollow interior of said rider support structure, said reclining seat structure being structured and disposed to support at least one rider therein in a generally reclined position, a pair of straps formed of a flexible yet high strength material, each strap of said pair having a first end and a second end, each one of said pair of straps being securely yet removably connected to one of said opposite sides of said rider support structure such that when the assembly is disposed in a launched orientation each of said straps is disposed in spaced, generally parallel relation to the other so as to provide for balance and stable movement of said rider support structure, guide means attached to said rider support structure for guiding and restricting the movement of said straps and structured and disposed to maximize observation of the rider seated within said rider support structure, each of said pair of straps including near a center region thereof means for connecting with at least one set of riser lines of a parachute, and upon connection of the parachute riser lines to said connecting means of said straps, said rider support structure being movable between the launched orientation, wherein said rider support structure is suspended by the parachute when filled with air and disposed in depending relation thereto, and a floating orientation on a surface of water when the parachute is not filled with air.

10. An parasailing assembly as recited in claim 9, wherein said guide means comprise a pair of upstanding, rigid, tubular arm members, each one of said pair being secured to opposite sides of said rider support structure.

11. An improved rider support assembly for parasailing as recited in claim 10 wherein each of said upstanding, rigid tubular arm members has a generally inverted "U" shape, is disposed generally on a peripheral region of said top side of rider support structure, and further wherein one of said pair of straps passes through one of said pair of rigid tubular arm members.

12. A parasailing assembly as recited in claim 9 wherein said rider support structure has an aerodynamic generally wedge shape.

13. A parasailing assembly as recited in claim 9 wherein said means for connecting with at least one set of riser lines of a parachute comprise a clip attached to each strap and a D-ring attached to said at least one set of riser lines.

14. A parasailing assembly as recited in claim 9 wherein said means for connecting with riser lines of a parachute comprises an interconnecting link formed on a central region of each strap and securely sewn onto a common base portion of a set of three groups of riser lines.

15. A parasailing assembly designed to suspend a rider from an air filled parachute being towed by a boat, said assembly comprising:

a rider support structure formed of a substantially rigid yet substantially lightweight and buoyant material, said rider support structure having a front end, a rear end, a pair of oppositely disposed sides, a top side, a bottom side, and a generally hollow interior accessible from one of said sides;

a generally reclining seat structure disposed within said hollow interior of said rider support structure, said reclining seat structure being structured and disposed to support at least one rider therein in a substantially seated position, a pair of straps formed of a flexible yet high strength material, each strap of said pair having a first end and a second end, each one of said pair of straps being securely yet removably connected to one of said opposite sides of said rider support structure such that when the assembly is disposed in a launched orientation each of said straps is disposed in spaced, generally parallel relation to the other so as to provide for balance and stable movement of said rider support structure, a pair of upstanding, rigid, generally inverted "U" shaped, tubular arm members attached to said rider support structure and structured and disposed to maximize observation of the rider seated within said rider support structure, each one of said pair of tubular arm members attached to opposite sides thereof on said top side generally nearer to said front end than said rear end, and aligned to generally correspond a location of the other thereon, each one of said pair of straps passing through a passage formed by said generally inverted "U" shape within said tubular arm members, so as to guide and restrict the movement of said straps, each of said pair of straps including near a center region thereof means for connecting with at least one set of riser lines of a parachute, and upon connection of the parachute riser lines to said connecting means of said straps, said rider support structure being movable between the launched orientation, wherein said rider support structure is suspended by the parachute when filled with air and disposed in depending relation thereto, and a floating orientation on a surface of water when the parachute is not filled with air.

16. A parasailing assembly as recited in claim 15, wherein said upstanding, rigid, tubular arm members have a height of generally between about twelve to fourteen inches.

17. A parasailing assembly as recited in claim 16, wherein said each of said straps include an interconnecting link securely formed thereon and structured and disposed to interconnect one of said straps, at a generally center region thereof, with a common base portion of a set of three groupings of parachute riser lines.

18. A parasailing assembly as recited in claim 17, wherein said reclining seat structure comprises a seat brace securely connected to said rider support structure and extending transversely across a width thereof so as to support a rider seated thereon, a seat back support portion extending transversely across a width thereof so as to support a rider's back, and a padded reclining and seating support member extending from said seat brace to said seat back support portion.

19. A parasailing assembly as recited in claim 18, wherein said hollow interior of said rider support structure is sized and configured to at least substantially encircle the rider seated therein and is accessible from a top side of said rider support structure.

20. A parasailing assembly as recited in claim 17, wherein said rider support structure includes a slotted foot rest disposed therein, positioned to correspond the placement of a rider's feet and structured to support the weight of at least one rider.

21. A parasailing assembly as recited in claim 17, wherein said bottom side of said rider support structure includes a pair of spaced apart float structures with a distance between front ends thereof being less than a distance between back ends thereof.

22. A parasailing assembly as recited in claim 20 wherein said rider support structure has an aerodynamic generally wedge shape.

23. A parasailing assembly as recited in claim 17 wherein said rider support structure includes an illumination structure connected thereto.

* * * * *